United States Patent [19]

Yamaguchi

[11] Patent Number: 4,654,767

[45] Date of Patent: Mar. 31, 1987

[54] LAMPSHADE

[76] Inventor: Masami Yamaguchi, 519-14, Kamihiruta, Kasukabe-shi, Saitama-ken, Japan

[21] Appl. No.: 838,808

[22] Filed: Mar. 12, 1986

[30] Foreign Application Priority Data

Mar. 18, 1985 [JP] Japan ..... 60-38731[U]
Jul. 15, 1985 [JP] Japan ..... 60-108079[U]

[51] Int. Cl.[4] ..... F21V 1/06
[52] U.S. Cl. ..... 362/352; 362/360
[58] Field of Search ..... 362/351, 352, 311, 360, 362/354, 806, 278, 279; 373/155; D11/141; 493/950

[56] References Cited

U.S. PATENT DOCUMENTS

| | | | |
|---|---|---|---|
| 2,435,786 | 2/1948 | Klosek | 362/354 |
| 3,451,881 | 6/1969 | Gurule | 362/352 |
| 3,736,418 | 5/1973 | Havlova | 362/360 |
| 3,895,229 | 7/1975 | Strom | 362/351 |

FOREIGN PATENT DOCUMENTS

| | | | |
|---|---|---|---|
| 2900037 | 7/1979 | Fed. Rep. of Germany | 362/351 |
| 140394 | 5/1953 | Sweden | 362/351 |
| 222060 | 9/1924 | United Kingdom | 302/352 |

*Primary Examiner*—William A. Cuchlinski, Jr.
*Assistant Examiner*—D. M. Cox
*Attorney, Agent, or Firm*—Shlesinger, Arkwright, Garvey & Fado

[57] ABSTRACT

A lampshade made in accordance with this invention is characterized in that it consists solely of a plurality of comparatively thin sheets of a same shape corresponding to a front vertical cross-sectional view of the lampshade or a vertically cut out half of said view. Each sheets has strips which are aligned in parallel with each other, and each strip has a base portion located adjacently to an outer contour of the sheet and a free end located oppositely to the base portion. When the plurality of sheets bound together at least at upper ends thereof are framed to the lampshade, they extend radially outwardly with a desired angular distance therebetween and strips thereof bridge over the outer contours of the sheets.

4 Claims, 10 Drawing Figures

Fig.1-A
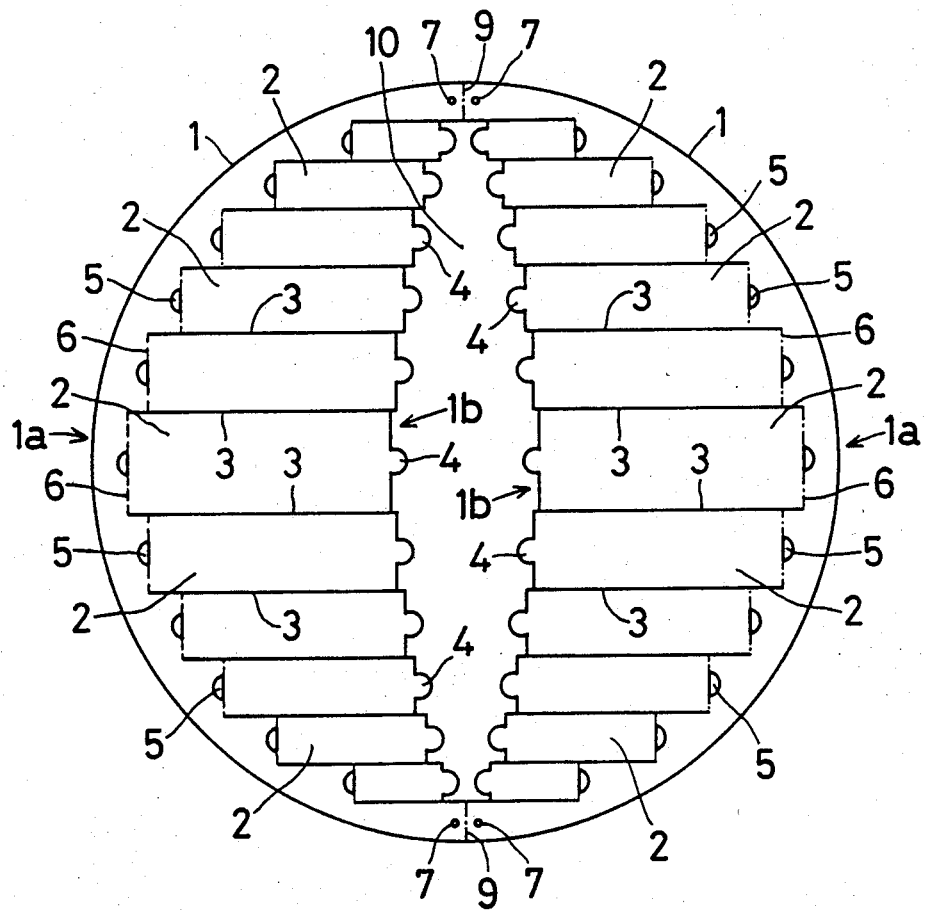

LAMPSHADE

BACKGROUND AND BRIEF SUMMARY OF THE INVENTION

This invention relates to a pretty lampshade of a novel idea for various lighting fixtures, which can be made readily by a combination of a plurality of sheets which have been cut out to a same configuration.

Contrarily to the lampshade made in accordance with this invention, conventional lampshades have drawbacks in that they are difficult to shape them whereby they become expensive, and that they are so bulky that they are difficult for transporting and storing them.

Hence, it is an object of this invention to provide a lampshade consisting of a plurality of sheets cut out to a same shape having aligned shading strips or slabs, which sheets can readily be assembled to the pretty lampshade and which sheets can easily be folded flat so that it can conveniently be handled and stored.

The sheets which constitute the lampshade of this invention; are correspondent by their shapes to a front vertical sectional view of the desired lampshade or a vertically cut half of said front view, are made by sheet materials such as cardboard, and synthetic resin or metallic films; are provided with a number of shading strips or slabs which are made by slitting the sheet from its free inner edge and adjacently to its outer edge so that the strips are aligned in parallel with each other, inner connecting line of which are curved in accordance with curvature of said outer edge, and which are provided with tongues at their free ends and openings at their ends opposite to the free ends; and are provided at upper and lower rim sides with perforations. The plurality of sheets bundled to each other at their top and lower ends or at one of the ends are bent so that they are located each other with an angular distance therebetween and so that the tongues of the strips of a sheet are insertedly fitted into the corresponding openings of another sheet so as to complete the assembly of the lampshade.

BRIEF DESCRIPTION OF THE DRAWING

In the drawing illustrating the lampshades made in accordance with this invention.

DETAILED DESCRIPTION

Figure 1:
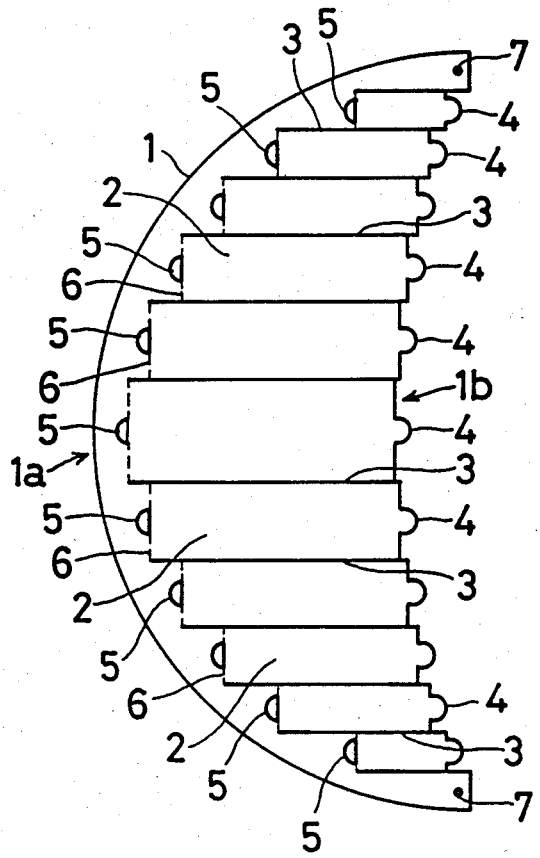
FIG. 1 is a front view of a sheet constituting the lampshade.
Figure 2:
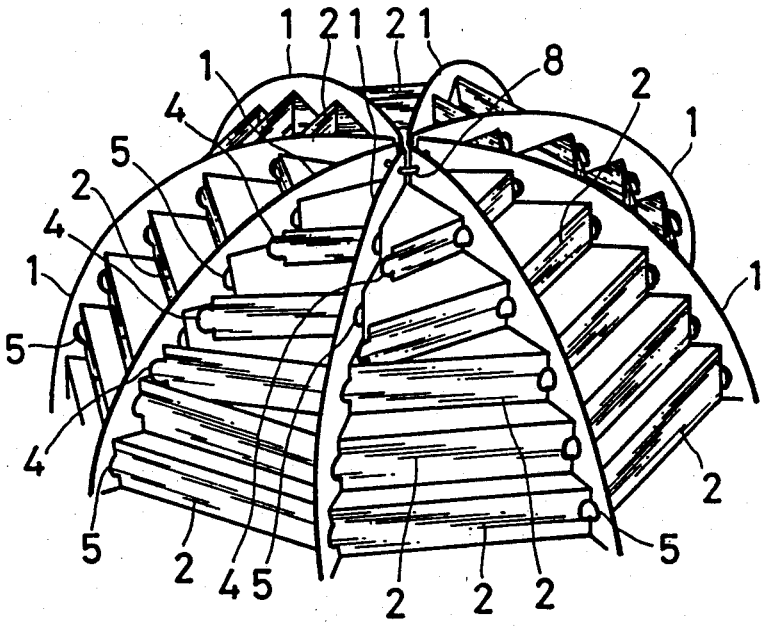
FIG. 2 is a perspective view showing a part of the lampshade in a semi-assembled form.
Figure 3:
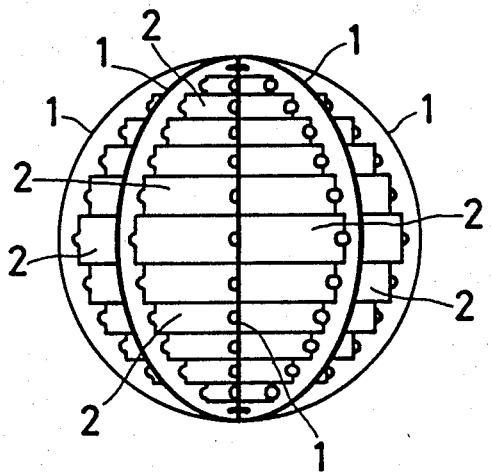
FIG. 3 is a front view of the lampshade of a globular shape in a completely assembled form, FIG. 1-A is a front view of another sheet constituting the lampshade, this another sheet being consisted of an integral pair of the symmetrical sheets of FIG. 1.
Figure 4:
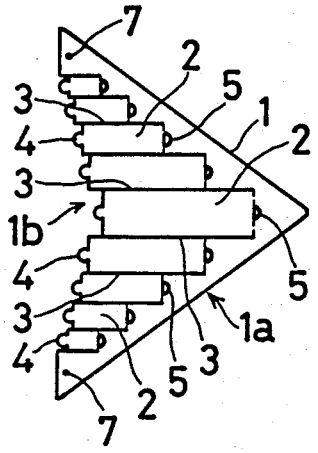
FIG. 4 is a front view of a sheet constituting the lampshade of a different configuration, viz., of a sixteen-faced polyhedron.
Figure 5:
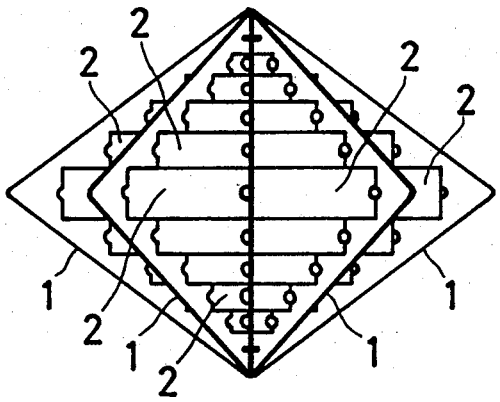
FIG. 5 is a front view of the lampshade made by assembling a number of sheets illustrated in FIG. 4.
Figure 6:
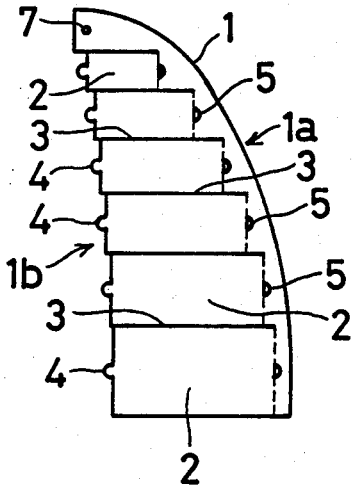
FIG. 6 is a front view of another sheet constituting the lampshade of another different configuration, that is, of a hanging bell-like shape.
Figure 7:
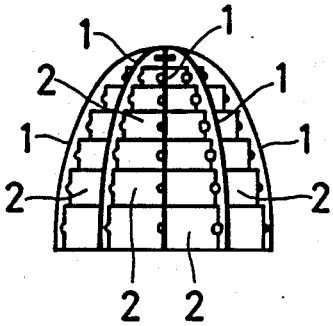
FIG. 7 is a front view of the lampshade made by employing the sheets of FIG. 6.

In an embodiment of this invention illustrated in FIGS. 1, 2 and 3 in which a lampshade of a substantially globular form is shown, a plurality of sheets 1 which are cut out and shaped to a same configuration, are employed. Said sheets are of paper sheets such as strawboard, films of synthetic resins, and metallic films. The number of sheets 1 employed in this embodiment is eight. The configuration of said sheets 1 is a semicircle when they are employed to frame a lampshade of a substantially globular form as shown in FIG. 3. The configuration may be triangular as illustrated in FIG. 4 when the sheets are intended to frame a lampshade of a sixteen-faced polyhedron as illustrated in FIG. 5. Or, said configuration will be of an upper half of crescent as illustrated in FIG. 6, when the sheets 1 are employed to frame a lampshade of a hanging bell-like shape as illustrated in FIG. 7. In other words, each sheet 1 follows a configuration of one of halves which are vertically cut off from a front section of a complete or assembled lampshade.

Numerals 2 represent a plurality of strips or slabs which are made by slitting the sheets 1 along lines 3 so that they are formed to lie in parallel to each other and so that they extend completely from inner rims 1*b* and adjacently to outer rims 1*a* which frame outer contours of the complete or assembled lampshade of this invention. A supposed connecting line of free ends of the strips 2 or those ends which are at the inner rim 1*b* are curved inwardly in accordance with a curvature of the outer rim 1*B* of the sheet 1. Numerals 4 are semi-circular small tongues integrally formed with the sheet 1 at free ends of strips thereof. And, numerals 6 represent bending lines formed vertically in the drawing along a base portion of each strips 2. On the sheet 1, there are provided at the outside of and along each bending lines 6 semi-circular cut-out openings 5 which are tightly engageable with the tongues 4 of another sheet which is assembled to a lampshade next to the above sheet 1.

Numerals 7 are perforations which are made at upper and lower ends or one of the ends (only at the upper end in FIGS. 6 and 7) of each sheets 1, and through which perforations fastening means such as rings are provided to a lampshade so that the sheets which constitute the lampshade can be bound together and the lampshade as a whole can be suspended.

Now, a plurality of (eight in this case) sheets 1 of FIG. 1 are assembled to a lampshade of a substantially globular form (of FIG. 3) as follows. Eight sheet 1 of FIG. 1 is first bundled or bound to each other loosely by means of rings fitted to the perforations 7. Then, the strips 2 of the bundled sheets 1 are bent at the bending lines 6 to a same direction. As best shown in FIG. 2, the tongues 4 of each sheet are insertedly fitted into the openings 5 of a sheet bundled next to said sheet in the bending direction of strips, whereby a lampshade as shown in FIG. 3 is completely assembled. In the lampshade assembled thus to a globular form, one can not see inside thereof from its front, but can see the inside from upper, lower, or slanted directions. It shall be noted that before completely assembling the sheets 1 into a lampshade, a lamp with a socket can be housed in the lampshade so that it can be suspended within the lampshade when it is completely assembled.

In another embodiment of this invention illustrated in FIG. 1-A, and contrarily to the embodiment shown in FIGS. 1 to 3, the sheet 1 does not take a configuration of one of halves of a front sectional view of a desired lampshade of a substantially globular from, but it follows the entire front vertical sectional view of the lampshade, viz., a discal shape in this instance having a central large opening or cut-out 10 about which the strips or slabs 2 extend and align symmetrically. Configurations and constructions of the strips 3, the tongues 4 and the openings 5 thereof are same to those of the first embodiment of FIG. 1. Numeral 9 represents folding lines which are provided vertically and centrally of the sheet and at outer rim sides, and about which the sheet can be bent inwardly or outwardly as desired. The sheet shown in FIG. 1-A could be said, in other words, that it consists of a pair of the sheets illustrated in FIG. 1. The assembly method of the sheets 1 of FIG. 1-A is exactly same to the manner explained above in connection with FIGS. 1 to 3.

As explained above, triangular sheets 1 as illustrated in FIG. 4 are employed to frame the lampshade of sixteen-faced polyhedron as illustrated in FIG. 5. And, likewise, sheets 1 having a shape of an upper half of crescent as illustrated in FIG. 6 are employed to frame the lampshade of a hanging bell-like contour as illustrated in FIG. 7.

Figure 8:
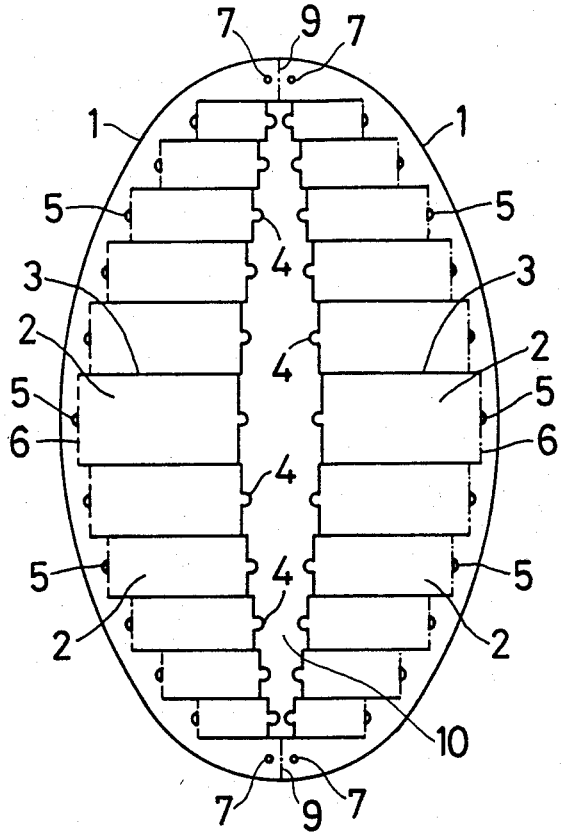
FIG. 8 is a front view of further another sheet constituting the lampshade of an egg shape.
Figure 9:
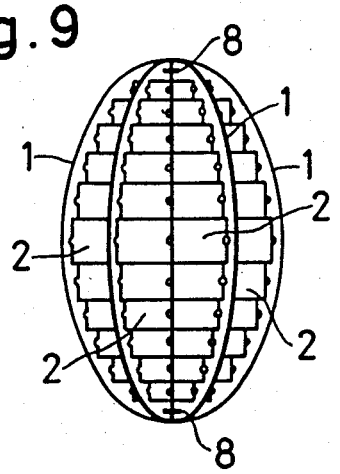
FIG. 9 is a front view of the lampshade made by assembling the sheets of FIG. 8.

An oval shaped sheet 1 illustrated in FIG. 8 is to frame an egg-shaped lampshade of FIG. 9. In this embodiment, the sheet 1 follows an entire vertical cross-sectional front view of the desired shade in place of its vertically cut-out half. The assembly of this sheets 1 is exactly same to the second embodiment explained above with reference to FIG. 1-A.

As explained in detail in the above, since the lampshade of this invention is simply consisted of a plurality of sheets of a same shape which corresponds to a front vertical cross-sectional view of a desired lampshade or which corresponds to a vertically cut-out half of said front view, and since its shading effects can be obtained by a number of strips or slabs formed in the sheets by slitting them, manufacture thereof is extremely easy and designs thereof can easily be changed as desired. Assembly thereof is also extremely easy, and the lampshade of this invention can readily be folded flat and kept in layers for easy storing and transportation thereof.

I claim:

1. A lampshade which is characterized in that it is simply and solely consisted of a plurality of comparatively thin sheets of a same configuration corresponding to a shape of the lampshade taken at its front cross-sectional view, each sheet having a central axis about which and at both sides of which a plurality of strips are symmetrically provided, said strips are made by slitting the sheet transversely to the central axis thereof so that each strip has an outer base portion which is integral with the sheet and bendable, an opening adjacent to its base portion, and an inner free end with a tongue, and the sheets which are bound together at least at top portions thereof being, when folded along their central axes, extended about the central axis and radially outwardly with a desired angular distance therebetween, and strips thereof which are bent at base portions thereof to a selected direction extending substantially transversely to the plane of the radially outwardly extended sheets and bridging over an outer contour of said sheets, whereby the tongues of one sheet being insertedly fitted to the openings of another sheet located next to said one sheet.

2. A lampshade as claimed in claim 1, in which each sheet is a half of the sheet having a configuration corresponding to a shape of the lampshade taken at its front cross-sectional view, which half is made by cutting said view along central axis thereof.

3. A lampshade as claimed in claim 1, in which the inner free ends of the strips substantially follow curvatures of the outer contour of the sheets.

4. A lampshade as claimed in claim 1, in which the sheets are made of paper board, films of synthetic resins and metals and the shade is of a substantially globular, multi-faced polyhedron, hanging bell-like, or egg-like form.

* * * * *